US006298866B1

(12) United States Patent
Molnar, IV

(10) Patent No.: US 6,298,866 B1
(45) Date of Patent: Oct. 9, 2001

(54) TABLE UMBRELLA APPARATUS

(76) Inventor: William F. Molnar, IV, 3535 N. Dallas #704, Houston, TX (US) 77019

( * ) Notice: Subject to any disclaimer, the term of this patent is extended or adjusted under 35 U.S.C. 154(b) by 0 days.

(21) Appl. No.: 09/546,695

(22) Filed: Apr. 10, 2000

(51) Int. Cl.[7] ..... A45B 3/00; A45B 23/00

(52) U.S. Cl. ..... 135/16; 135/98; 135/910; 108/50.12; 108/50.13; 362/102

(58) Field of Search ..... 135/16, 98, 910; 108/58.12, 58.13; 362/102

(56) References Cited

U.S. PATENT DOCUMENTS

| | | | | |
|---|---|---|---|---|
| 1,148,332 | * | 7/1915 | Onyskow . | |
| 2,962,248 | * | 11/1960 | Ertel et al. . | |
| 3,444,799 | * | 5/1969 | Covington | 135/16 |
| 3,563,502 | * | 2/1971 | Dayson . | |
| 3,739,792 | * | 6/1973 | Holland | 135/16 |
| 3,801,809 | * | 4/1974 | Slade . | |
| 4,174,532 | * | 11/1979 | Kelley | 362/102 |
| 4,623,367 | * | 11/1986 | Paulson . | |
| 5,000,384 | * | 3/1991 | Arnild | 239/128 |
| 5,007,811 | * | 4/1991 | Hopkins | 135/16 |
| 5,172,711 | * | 12/1992 | Mueller et al. | 135/16 |
| 5,207,238 | * | 5/1993 | Rivera et al. | 135/16 |
| 5,331,524 | * | 7/1994 | Tseng | 362/102 |
| 5,463,535 | * | 10/1995 | Vest | 362/102 |
| 5,568,909 | * | 10/1996 | Timko | 248/519 |
| 5,685,517 | * | 11/1997 | Salibra | 248/519 |
| 5,758,856 | * | 6/1998 | Carnahan et al. | 248/523 |
| 5,769,000 | * | 6/1998 | Dunfey | 108/23 |
| 5,964,233 | * | 10/1999 | Clark et al. | 135/16 |
| 5,979,793 | * | 11/1999 | Louis | 239/128 |
| 6,017,188 | * | 1/2000 | Benton | 416/5 |
| 6,027,309 | * | 2/2000 | Rawls et al. | 416/5 |

FOREIGN PATENT DOCUMENTS

| | | | | |
|---|---|---|---|---|
| 4303677 | * | 8/1994 | (DE) | 135/16 |
| 2617689 | * | 1/1993 | (FR) | 135/16 |
| 93000840 | * | 1/1993 | (WO) | 135/16 |

* cited by examiner

*Primary Examiner*—Robert Canfield
(74) *Attorney, Agent, or Firm*—Harrison & Egbert

(57) ABSTRACT

A table umbrella apparatus having a base, an umbrella with an inner surface extending therealong, a tubular support affixed to and extending from the base and supporting the umbrella a desired distance above the base, and a fan connected to the tubular support. The fan has a fan blade mounted so as to rotate about a vertical axis. The fan directs air flow at least upwardly toward the umbrella. A motor is connected to the fan so as to rotate the fan blade in a desired direction. A baffle is affixed to umbrella so as to direct air from the fan along the inner surface of the umbrella. The umbrella has at least one adjustable slat extending outwardly from the inner surface so as to direct air flow from the fan to a desired location below the umbrella. A table is positioned around the tubular support and over the base.

17 Claims, 2 Drawing Sheets

TABLE UMBRELLA APPARATUS

TECHNICAL FIELD

The present invention relates to table umbrellas. More particularly, the present invention relates to fans that can be utilized on patio tables. More particularly, the present invention relates to table umbrellas which include a fan for directing air toward or away from the person sitting around the table.

BACKGROUND ART

In many areas of the world, large umbrellas are used in conjunction with tables for the purpose of providing shade while dining or drinking outdoors. Heat and/or insects often reduce significantly an individual's capacity to enjoy outdoor leisure activities.

Various items have been employed in the past in conjunction with outdoor patio activities. In particular, electric fans have been used as a source of air for those sitting outside. Electric fans commonly use an electric motor with fan blades attached to the shaft of the rotor of the motor such that the electric motor is positioned central to the fan blades. Unfortunately, when the fan blades are used outside, they do not provide a great deal of protection from the sun.

In the past, various table umbrellas have employed a variety of fan blade constructions. However, it is desirable to provide such a table umbrella apparatus at a moderate cost. As such, a need has developed for providing a table umbrella apparatus which can be manufactured inexpensively while still providing a downdraft of air to persons sitting below the table umbrella.

It is an object of the present invention to provide a table umbrella apparatus in which the umbrella can be used in conjunction with a fan to provide a breeze and shade to those sitting at the table.

Another object of the present invention is to provide a table umbrella apparatus in which the flow of air can be directed, as desired, to the person sitting below the table umbrella.

It is a further object of the present invention to provide a table umbrella apparatus in which the motor can be reversed so as to provide heated air to those sitting at the table.

It is a further object of the present invention to provide a table umbrella apparatus which can provide an evaporative cooling effect to those sitting below the table umbrella.

It is a further object of the present invention to provide a table umbrella apparatus which can transmit and/or deliver sound for the use and enjoyment of persons sitting below the table umbrella apparatus.

It is still a further object of the present invention to provide a table umbrella apparatus which can dispense a liquid to those sitting at the table.

It is still a further object of the present invention to provide a table umbrella apparatus which is easy to assemble, easy to use, and relatively inexpensive.

These and other objects and advantages of the present invention will become apparent from a reading of the attached specification and appended claims.

SUMMARY OF THE INVENTION

The present invention is a table umbrella apparatus which comprises a base, an umbrella having an inner surface extending therealong, a tubular support affixed to and extending from the base so as to support the umbrella a desired distance above the base, and a fan connected to the tubular support. The fan has a fan blade which is mounted so as to rotate about a vertical axis. The fan serves to direct air flow at least upwardly toward the umbrella and along the inner surface of the umbrella.

In the present invention, a motor is connected to the tubular support. The motor is drivingly connected to the fan so as to rotate the fan blade in at least one of two directions. The motor is capable of bi-directionally rotating the fan blade so as to cause the air flow to flow in one direction or another. The fan and the fan blade are mounted in a cage affixed to the tubular support. The umbrella is affixed to the cage opposite the tubular support. A baffle is affixed to the umbrella so as to direct air from the fan along the inner surface of the umbrella. The umbrella has at least one adjustable slat extending from the inner surface. The slat serves to direct air from the fan to a desired location below the umbrella.

In the present invention, a table is positioned around the tubular support and above the base. A plurality of struts are affixed to the underside of the table and extend from the tubular support. The plurality of struts maintain the table in a horizontal plane. Alternatively, the table has a plurality of legs connected to an underside thereof so as to support the table in a horizontal plane a desired distance above an underlying surface.

In the present invention, an evaporative cooling means is affixed to the tubular support and extends along the inner surface of the umbrella. The evaporative cooling means serves to pass a cooling mist below the umbrella. The base has a water reservoir formed therein. A pump is provided to direct water from said base through a conduit extending through the tubular support from the water reservoir. The evaporative cooling means has a nozzle connected to the conduit and is directed downwardly from the unbrella The pump serves to force water through said nozzle. A switch is connected to the tubular support so as to allow users to selectively activate the mist system.

In the present invention, a heating element is affixed to the tubular support and positioned below the fan. The fan directs the air flow downwardly over the heating element. A light is connected to the tubular support and is positioned below the fan. The light has an electrical line extending through the tubular support to a power supply. A speaker is affixed to the cage surrounding the fan. The speaker has an electrical line connected thereto and extending through the tubular support. A power supply is electrically connected to the fan. The power supply is positioned in the base. The power supply has an electrical line extending through the tubular support to the fan. A liquid dispenser line extends outwardly of the tubular support and is connected to a liquid supply (in the form of a reservoir in the base or by a PVC line) so as to selectively supply liquid outwardly therefrom.

DETAILED DESCRIPTION OF THE INVENTION

Figure 1:
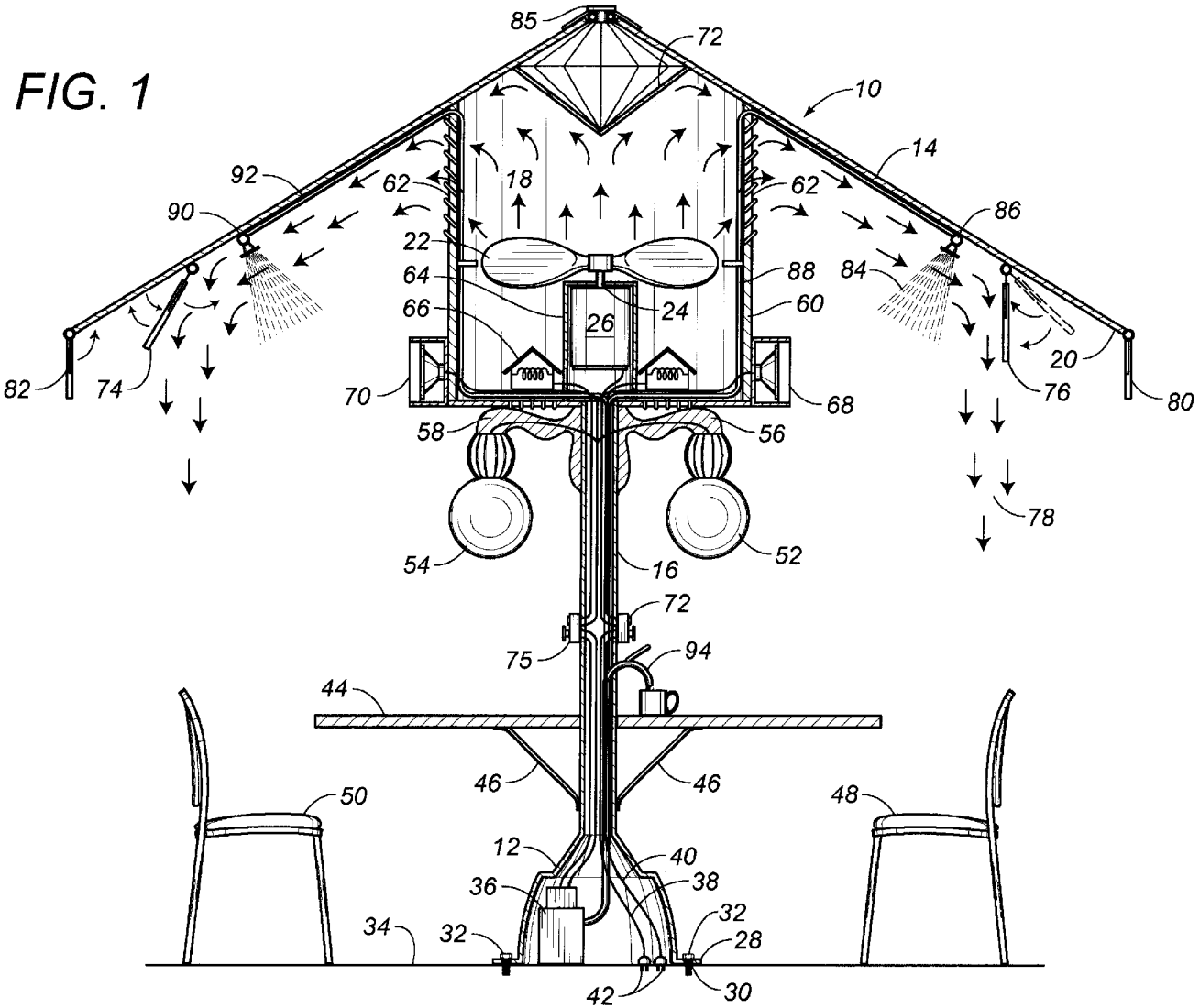
FIG. 1 is a cross-sectional side view showing the table umbrella apparatus in accordance with the preferred embodiment of the present invention.

Referring to FIG. 1, there is shown the table umbrella apparatus 10 in accordance with the teachings of the present invention. The table umbrella apparatus includes abase 12, an umbrella 14, a tubular support 16 and a fan 18. The umbrella 14 has an inner surface 20 extending therealong. The tubular support 16 is affixed to and extends from the base 12. The tubular support 16 serves to support the umbrella 14 a desired distance above the base 12. The fan 18 is interconnected to the tubular support 16. The fan 18 has a fan blade 22 which is mounted so as to rotate about a vertical axis represented by the shaft 24 of motor 26. The fan 18 serves to direct air flow at least upwardly (as shown by the arrows) toward the umbrella 14.

In FIG. 1, it can be seen that the base 12 has a radially outwardly extending flange 28. Flange 28 includes bolt holes 30 formed therein which allow bolts 32 to be inserted therein for securing the table umbrella apparatus 10 to a surface, such as floor 34. The base 12 is suitably hollow so as to provide an area whereby liquid can be stored. Alternatively, a battery and/or power supply 36 can be inserted into the interior of the base 12. Still further and alternatively, electrical lines 38 and 40 can extend through the base 12 so as to be connected to a suitable electrical outlet 42.

A table 44 is positioned about the base 12. Struts 46 extend from the tubular support 16 to the underside of the table 44 so as to maintain the table 44 in a generally horizontal orientation in parallel alignment with the underlying surface 34. Chairs 48 and 50 can be positioned around the table 44, as desired.

As can be seen in FIG. 1, the tubular support 16 extends from the base 12 in the form of an ornate column. For example, for decorative purposes, the tubular support 16 can be in the form of an old fashioned light pole which includes light-emitting globes 52 and 54 extending from arms 56 and 58 extending radially outwardly of the tubular support 16. The tubular support 16 is suitably hollow so as to allow for the various conduits and lines to extend therethrough.

A cage 60 is mounted to the tubular support 16. The cage 60 surrounds the fan 18 and includes an air emitting area 62 thereon. The motor 26 is mounted within a housing 64 on the interior of the cage 60. Motor 26 has its shaft 24 extending upwardly therefrom so as to support the fan blades 22 thereon. The motor 26 is a motor capable of bidirectional rotation. As such, when the motor 26 is turned on, it can selectively rotate the fan blades 22 in the direction indicated in FIG. 1 so as to deliver air upwardly therefrom. Alternatively, the motor 26 can be reversed so that the fan blades 22 rotate in an opposite direction so as to drive air downwardly in the opposite direction from that shown in FIG. 1. A heating element 66 is positioned within the cage 60. Heating element 66 can be powered by a gaseous fuel or by electricity. When the heating element 66 is suitably heated, the downward draft of air passing from the fan blades 22 will pass toward the people sitting on the chairs 48 and 50 around the table 44 of the table umbrella apparatus 10. Suitable conduits extend through the interior of the tubular support 16 so as to deliver gaseous fuel and/or electricity to the heating element 66.

Speakers 68 and 70 are mounted on the exterior of the cage 60. Speakers 68 and 70 are provided so as to allow for sound, such as music, to be delivered to persons sitting around the table 44. Each of the speakers 68 and 70 can include suitable electrical lines which extend into the interior of the cage 60 and downwardly through the interior of the tubular support 16. Suitable controls 72 and/or 75 are provided on the exterior of tubular support 16 so as to allow the users to properly control the emission of sound, mist, heat and/or the fan from the table umbrella apparatus 10.

In FIG. 1, the cooling effect of the table umbrella apparatus 10 is particularly illustrated. In the form shown in FIG. 1, the fan blades 22 of fan 18 rotate so as to deliver an air flow upwardly toward the baffle 72. Baffle 72 directs air in a desired direction along the inner surface 20 of the umbrella 14. The air flow will travel along this inner surface 20 until the air flow encounters slats 74 and 76. FIG. 1 shows how the slats 74 and 76 can be adjusted so as to deliver the air flow 78 downwardly to the person sitting on the chair 48. A suitable mechanism is provided on the slat 76 to allow its adjustability relative to the surface of the umbrella 14. The umbrella 14 includes pivotable ends 80 and 82 which further allow for the directing of any residual air downwardly from the umbrella 14. Typically, the umbrella 14 will have a plurality of struts extending from a central pivot point 85. The slats 74 and 76 will be mounted between adjacent pairs of such struts. As such, the table umbrella apparatus 10 can be easily disassembled, as desired.

A cooling mist 84 is emitted from a nozzle 86 positioned on the inner surface 20 of the umbrella 14. A conduit 88 extends through the interior of the cage 60 and along the inner surface 20 of the umbrella 14 so as to be connected to nozzle 86. Conduit 88 is connected to a supply of liquid, and a pump, so that the liquid can be delivered to the nozzle 86. Another nozzle 90 is provided on the other side of the umbrella 14 and is connected to conduit 92 in a similar manner as described hereinbefore. When activated, a cooling mist 84 is emitted from the nozzle 86 so as to provide an evaporative cooling effect to those sitting below the umbrella 14.

Another feature of the present invention is a liquid dispenser 94 positioned adjacent to the top of the table 44. The dispenser 94 is connected to a supply of liquid located in the base 12 or elsewhere, so as to provide a supply of drinkable liquid to the users of the table umbrella apparatus 10.

The present invention provides a temperature control system which is suitable for both cold and hot outdoor environments. The bidirectional fan 18 serves to either cool the environment around the table umbrella apparatus 10 or to heat the area around the table 14. In order to cool the environment, the fan 18 forces air upward into the baffle 72. This will, in turn, direct air flow down the canvas of the umbrella 14. The air is then directed onto users of the table umbrella apparatus 10 by the adjustable vents or slats 74 and 76 that are positioned between the supports of the umbrella 14. When the fan 18 is combined with the mist 84, an evaporative cooling effect results.

By reversing the air flow downwardly over the heating element 66, the air is heated and directed onto persons sitting below the umbrella 14. This prevents the warm air from rising. The heat element 66 is positioned below the fan blades 22 surrounding the vertical shaft of the motor 26. The heating element 66 can either be electrically or propane powered. Electricity is provided to the heating element 66 by way of a conduit entering the base 12. Propane may be piped into the heating element 66 and provided by way of a refillable tank 36 positioned within the base 12.

FIG. 1 shows one embodiment of the present invention. The embodiment shown in FIG. 1 has a tubular support 16 which is in the form of a cast aluminum ornate street light pole. The tubular support 16 perfectly houses the support and enhances the look and feel of the table umbrella apparatus 10. The support strength of the tubular support 16 allows the table 44 to be easily supported without legs by way of the struts 46 positioned below the table 44. Lights 52 and 54 and outdoor speakers 68 and 70 are provided so as to complement the surroundings. The base 12 includes a plurality of bolt holes 30 which allows bolts to secure the base 12 to the underlying surface 34. Base 12 can provide for the storage of propane for heaters and/or a water reservoir for the mist system.

The fan 18 has a one-quarter horsepower motor 26 that is mounted vertically atop the tubular support 16. The fan 18 will include three or four rounded fan blades 22. The fan 18 and the motor should be weather resistant. An expanded metal cage 60 protects the fan 18 and attaches to and supports the umbrella 14 at the top thereof The breeze created by the fan 18 is directed upwardly toward the inner surface 14. The baffle 72 directs the air flow down the umbrella toward the adjustable slats 74 and 76 that are positioned between the umbrella support struts. The slats 74 and 76 are adjustable by a suitable tension means at the ends where the slats 74 and 76 connect to the umbrella support struts. As a result, users of the table umbrella apparatus 10 can adjust the flow of air.

The present invention forces the circulation upwardly so as to keep the air flow off food and to distribute the air more evenly onto the users of the table umbrella apparatus 10. This breeze will help to keep bugs away. The breeze will also distribute the mist for an evaporative cooling effect. The mist system includes high pressure tubing with mist nozzles 86 and 90. These mist nozzles 86 and 90 are brass and stainless steel fittings. The mist conduit runs along the outer edge of the umbrella near the struts. The mist line is connected to the umbrella support struts near the vents. Water may be supplied to the system in one of three ways. The first way is to hook a nozzle up to the system at the base 12 or to run PVC tubing into the base 12 into the control valve. Tap water pressure would be sufficient enough to run the mist nozzles 86 and 90. A water shut off valve can also be used to control the mist nozzles 86 and 90.

The table umbrella apparatus 10 of the present invention can be easily broken down for the purpose of shipping. The umbrella 14 can be easily lowered, in a conventional manner, in extreme weather conditions. The table umbrella apparatus 10 is designed to handle typical wind and weather conditions when fully assembled. In order to lower the umbrella, it is only necessary to unhook the umbrella support struts and to slip off the tips of the umbrella.

Figure 2:
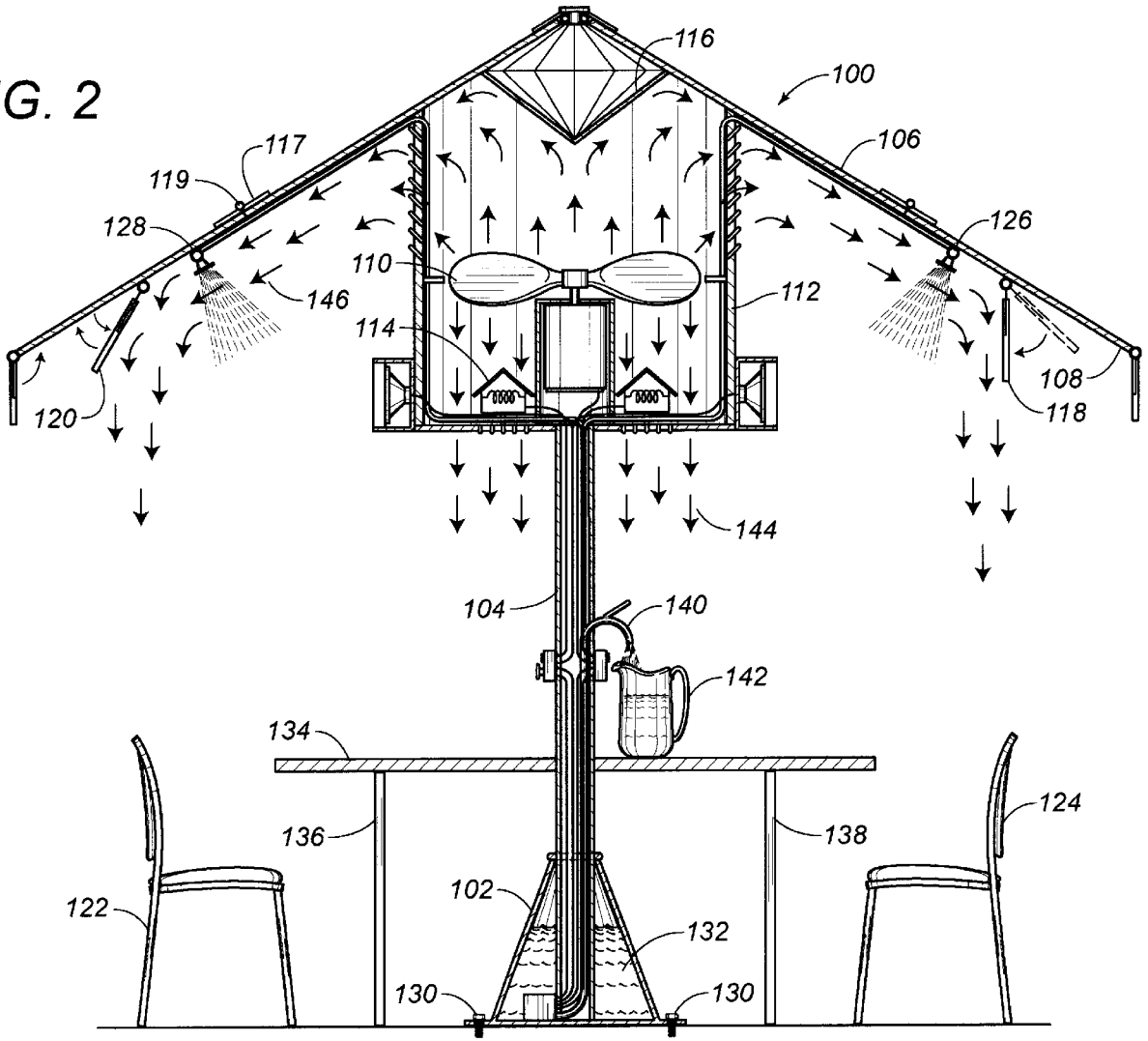
FIG. 2 is a cross-section side view showing the table umbrella apparatus in accordance with an alternative embodiment of the present invention.

FIG. 2 shows an alternative embodiment of the table umbrella apparatus 100 of the present invention. The alternative embodiment is intended to show the present invention as used in traditional cafe settings (which have a standard pole extending through the center of the table). The present invention replaces this standard pole. The table umbrella apparatus 100 includes a base 102, a tubular support 104, an umbrella 106 having an inner surface 108 and a fan 110. The fan 110 is positioned within a cage 112 mounted on top of the tubular support 104 in the manner described herein previously. A heating element 114 is positioned below the fan 110. A baffle 116 is positioned above the fan 110 so as to direct air flow along the inner surface 108 of umbrella 106. The umbrella 106 includes slats 118 and 120 which serve to direct the air flow downwardly toward persons sitting on chairs 122 and 124 below the umbrella 106. Mist nozzles 126 and 128 are provided on the inner surface 108 of the umbrella 106 so as to create the evaporative cooling effect.

In FIG. 2, it can be seen that the base 102 has a generally conical configuration. The tubular support 104 will reside in the center of the base 102. The base 102 can be secured by bolts 130 to an underlying surface or can be filled with a liquid 132 so as to provide suitable ballast. The table 134 has legs 136 and 138 extending therebelow so as to maintain the table 134 in a generally horizontal plane and to provide enhanced stability to the apparatus. Unlike the previous embodiment, the legs 136 and 138 are not directly connected to the tubular support 104 but are, instead, extending from the underlying surface. A liquid dispenser 140 will extend through the interior of the tubular support 104 so as to open within the interior of the base 102. As such, the liquid 132 can be dispensed above the table 134 into a container 142. A suitable pump can be provided in the base 132 so as to deliver the liquid, as needed. Additionally, the pump can also be provided so as to deliver the liquid for the purposes of creating the cooling mist from the mist nozzles 126 and 128. It is preferred that the liquid 132 be distilled water so as to prevent any mineral buildup on the mist nozzles 126 and 128. Arrows 144 are illustrated in FIG. 2 so as to show the effect of heating caused by rotating the fan 110 so as to create a flow of air downwardly over the heating element 114. Arrows 146 are shown in FIG. 2 so as to show the cooling effect created by the upward flow of air from the fan 110.

This embodiment allows the umbrella 106 to be lowered by appropriate hingings for proper shipping and in the event of severe weather conditions. A support strut attaches to the vent support structure. The support strut has a pull pin 119 residing in a drilled hole formed in the vent support structure 117. This arrangement allows the pull pin 119 to be removed and the struts to be lowered. The hinges can be formed in the vent support structure just beyond the protective cage.

This embodiment allows the umbrella 106 to be lowered by appropriate hingings for proper shipping and in the event of severe weather conditions. A support strut attaches to the vent support structure. The support strut has a pull pin 119 residing in a drilled hole formed in the vent support structure 117. This arrangement allows the pull pin 119 to be removed and the struts to be lowered. The hinges can be formed in the vent support structure just beyond the protective cage.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A table umbrella apparatus comprising:

a base;

an umbrella having an inner surface extending therealong;

a tubular support affixed to and extending from said base, said tubular support supporting said umbrella a desired distance above said base;

a fan means connected to said tubular support, said fan means having a fan blade mounted so as to rotate about a vertical axis, said fan means directing air flow at least upwardly towards said umbrella, said fan means for causing either an evaporative cooling effect or a heating effect; and a motor connected to said tubular support, said motor drivingly connected to said fan means so as to rotate said fan blade, said motor capable of bi-directionally rotating said fan blade, said fan means and said fan blade being mounted in a cage affixed to said tubular support, said umbrella affixed to said cage opposite said tubular support.

2. The apparatus of claim 1, further comprising:

a baffle affixed to said umbrella so as to direct air from said fan means along said inner surface of said umbrella.

3. The apparatus of claim 1, further comprising:

a table positioned around said tubular support and above said base.

4. The apparatus of claim 3, further comprising:

a plurality of struts affixed to an underside of said table and extending from said tubular support, said plurality of struts maintaining said table in a horizontal plane.

5. The apparatus of claim 3, said table having a plurality of legs connected to an underside thereof so as to support said table in a horizontal plane a desired distance above an underlying surface.

6. The apparatus of claim 1, said fan means comprising:

an evaporative cooling means affixed to said tubular support and extending along said inner surface of said umbrella, said evaporative cooling means for passing a cooling mist below said umbrella.

7. The apparatus of claim 6, said base having a water reservoir therein, said evaporative cooling means having a conduit extending through said tubular support from said water reservoir, said evaporative cooling means having a nozzle connected to said conduit and directed downwardly from said inner surface of said umbrella.

8. The apparatus of claim 1, further comprising:

a light connected to said tubular support and positioned below said fan blade, said light having an electrical line extending through said tubular support to a power supply.

9. The apparatus of claim 8, said light being in the form of a street lamp having a globe extending downwardly from an arm extending radially outwardly of said tubular support.

10. The apparatus of claim 1, further comprising:

a power supply electrically connected to said fan means, said power supply being positioned in said base, said power supply having an electrical line extending through said tubular support to said fan means.

11. The apparatus of claim 1, said base having a flange extending radially outwardly therefrom at a bottom of said base, said flange having bolt holes formed therein so as to allow said base to be affixed to an underlying surface.

12. A table umbrella apparatus comprising:

a base;

an umbrella having an inner surface extending therealong;

a tubular support affixed to and extending from said base, said tubular support supporting said umbrella a desired distance above said base;

a fan means connected to said tubular support, said fan means having a fan blade mounted so as to rotate about a vertical axis, said fan means directing air flow at least upwardly towards said umbrella, said fan means for causing either an evaporative cooling effect or a heating effect; and a cage affixed to said tubular support and extending upwardly therefrom, said umbrella being affixed to a top of said cage opposite said tubular support, said fan blade positioned interior of said cage, said cage having openings directed towards an inner surface of said umbrella.

13. The apparatus of claim 12, further comprising:

a speaker affixed to said cage, said speaker having an electrical line connected thereto and extending through said tubular support.

14. A table umbrella apparatus comprising:

a base;

an umbrella having an inner surface extending therealong;

a tubular support affixed to and extending from said base, said tubular support supporting said umbrella a desired distance above said base; and a fan means connected to said tubular support, said fan means having a fan blade mounted so as to rotate about a vertical axis, said fan means directing air flow at least upwardly towards said umbrella, said fan means for causing either an evaporative cooling effect or a heating effect, said fan means comprising:

a heating element affixed to said tubular support and positioned below said fan blade, said fan blade directing said air flow downwardly over said heating element.

15. The apparatus of claim 14, said heating element being powered by a gaseous fuel, said fuel retained in said base, said heating element having a fuel passing line extending through said tubular support.

16. A table umbrella apparatus comprising:

a base;

an umbrella having an inner surface extending therealong;

a tubular support affixed to and extending from said base, said tubular support supporting said umbrella a desired distance above said base; and a fan means connected to said tubular support, said fan means having a fan blade mounted so as to rotate about a vertical axis, said fan means directing air flow at least upwardly towards said umbrella, said fan means for causing either an evaporative cooling effect or a heating effect, said umbrella having at least one adjustable slat extending from said inner surface, said slat for directing air flow from said fan means to a desired location below said umbrella.

17. A table umbrella apparatus comprising:

a base having a liquid supply therein;

an umbrella having an inner surface extending therealong;

a tubular support affixed to and extending from said base, said tubular support supporting said umbrella a desired distance above said base;

a fan means connected to said tubular support, said fan means having a fan blade mounted so as to rotate about a vertical axis, said fan means directing air flow at least upwardly towards said umbrella, said fan means for causing either an evaporative cooling effect or a heating effect; and a liquid dispenser line extending outwardly of said tubular support, said liquid dispenser line connected to said liquid supply so as to selectively dispense said liquid supply outwardly therefrom.

* * * * *